US005160425A

United States Patent [19]

Lewis

[11] Patent Number: 5,160,425

[45] Date of Patent: Nov. 3, 1992

[54] METHOD OF INHIBITING FORMATION OF FOULING MATERIALS DURING BASIC WASHING OF HYDROCARBONS CONTAMINATED WITH OXYGEN COMPOUNDS

[75] Inventor: Vincent E. Lewis, Missouri City, Tex.

[73] Assignee: Nalco Chemical Company, Naperville, Ill.

[21] Appl. No.: 718,623

[22] Filed: Jun. 21, 1991

[51] Int. Cl.[5] ..... C10G 57/00; C10G 9/16; C09K 15/22

[52] U.S. Cl. ..... 208/95; 252/403; 252/405; 208/48 AA; 208/47; 585/950

[58] Field of Search ..... 585/950; 252/403, 405; 208/95, 48 AA, 47

[56] References Cited

U.S. PATENT DOCUMENTS

| | | | |
|---|---|---|---|
| 3,258,485 | 6/1966 | Argyle | 252/405 |
| 3,364,130 | 1/1968 | Barnum et al. | 208/48 AA |
| 3,679,765 | 7/1972 | Houston, Jr. et al. | 260/683 R |
| 3,696,162 | 10/1972 | Kniel | 260/677 A |
| 3,761,534 | 9/1973 | Sun et al. | 260/674 A |
| 4,020,109 | 4/1977 | Fleck et al. | 260/601 R |
| 4,628,132 | 12/1986 | Miller | 585/4 |
| 4,673,489 | 6/1987 | Roling | 208/289 |
| 4,952,301 | 8/1990 | Awbrey | 208/48 AA |
| 5,078,966 | 1/1992 | Strong et al. | 252/392 |

*Primary Examiner*—Theodore Morris
*Assistant Examiner*—P. L. Hailey
*Attorney, Agent, or Firm*—Arnold, White & Durkee

[57] ABSTRACT

A method for inhibiting the formation of fouling materials during the caustic washing of hydrocarbons contaminated with oxygen compounds is disclosed. The method comprises adding an effective amount of carbohydrazide to the caustic wash system.

17 Claims, No Drawings

METHOD OF INHIBITING FORMATION OF FOULING MATERIALS DURING BASIC WASHING OF HYDROCARBONS CONTAMINATED WITH OXYGEN COMPOUNDS

BACKGROUND OF THE INVENTION

This invention relates to the prevention of fouling in which is in contact with a gaseous or liquid hydrocarbon stream.

In cracking operations, such as in the pyrolytic cracking of ethane, propane, and naphtha to form olefins, oxygenated compounds, including carbonyl compounds, are formed. The amount of carbonyl compounds, such as aldehydes and ketones, formed in such operations can vary widely, but is typically about 1-100 ppm in the gas stream with concentrations as high as 1000 ppm occasionally being encountered because of the utilization of various feedstocks and cracking temperatures. When the gas stream is passed through a basic wash (pH >7) to remove acidic components such as hydrogen sulfide and carbon dioxide, oxygen containing compounds, such as carbonyl compounds, are also removed. These oxygen containing compounds, particularly acetaldehyde, will undergo polymerization in the presence of the basic wash or scrubbing conditions. In the wash tower, the resulting polymer settles on the trays leading to fouling and eventual plugging of the trays. Eventually the unit must be shut down for cleaning— obviously a costly operation. The basic wash systems, where treatment is required to inhibit such polymer-based fouling, include amine acid gas scrubbers (e.g., MEA, DEA, isopropyl amine, butyl amine, etc.) and caustic wash systems.

Polymer based fouling is inhibited in basic (pH 7) wash systems of the type adapted to remove impurities from liquid or gas phase hydrocarbon mediums by adding to the wash system a carbohydrazide compound. As used herein, "carbohydrazide compound" means a compound whose structure is shown by the formula $H_2NNHCONHNH_2$. Carbohydrazide is also known as carbazide and sometimes referred to as carbodihydrazide.

The carbohydrazide treatment is well suited for inhibition of polymer based deposits formed during the caustic scrubbing of gas phase olefinic hydrocarbons resulting from pyrolytic cracking processes. Heretofore, when such gas phase olefinic hydrocarbon streams were subjected to caustic wash systems, the carbonyl compounds therein, including ketone and aldehyde contaminants, tended to undergo Aldol condensation, forming insoluble polymer molecules. The polymers deposited on system equipment and, for instance, tended to plug the trays in the caustic wash tower.

The inventive method is particularly appropriate for the basic washing process which follows the pyrolytic cracking of such hydrocarbons as ethane, propane, butane, naphtha and mixtures thereof to produce the corresponding gaseous ethylene, propylene, butadiene and the like. These product streams contain the carbonyl and other contaminants.

Generally, the basic washing entails contacting the gaseous olefins with an aqueous basic solution in a wash tower to remove hydrogen sulfide, carbon dioxide and oxygenated compounds therefrom. The conditions in the wash tower are conducive for condensation reactions of any aldehydes (e.g., acetaldehyde) and/or ketones contained therein.

The present method entails assuring that the basic wash takes place in the presence of the carbohydrazide compounds. For example, carbohydrazide has been found to be an effective anti-polymerant for ethylene unit caustic towers and amine units used to scrub gases after the furnace but prior to the recovery section. During ethylene production, a small amount of partial oxidation products are formed. The major component of these partial oxidation products is acetaldehyde. The effluent from the ethylene furnace, containing acetaldehyde and other oxidation products, is washed in a caustic tower. This process removes acid gases such as carbon dioxide and hydrogen sulfide.

In some ethylene production units, an amine unit is used in front of the caustic tower to remove most of the acid gases. On contact with a caustic or amine solution, acetaldehyde and other aldehydes or ketones undergo a base catalyzed Aldol condensation. The result of these numerous Aldol reactions is a water insoluble polymer.

At some ethylene manufacturing facilities, a vinyl acetate plant is also present. Ethylene is used in the vinyl acetate production process. Unreacted ethylene is recovered by distillation and sent back through the ethylene unit fractionization train. Vinyl acetate can be entrained with the unreacted ethylene and enter the fractionization train. When vinyl acetate reaches the caustic tower it is hydrolyzed to produce a salt of acetic acid and vinyl alcohol. Vinyl alcohol tautomerizes to acetaldehyde, a source of the fouling polymer.

In U.S. Pat. No. 4,673,489, hydroxylamine and its hydrochloride and hydrogen sulfate salts have been used to inhibit polymer formation caused by condensation reactions of aldehydes contained in caustic scrubber units. However, despite the success of such treatments, these compounds are expensive and must be overfed to the caustic scrubber units in light of their apparent selectivity toward the ketone contaminant.

Similarly, in U.S. Pat. No. 4,952,301, ethylenediamines and water soluble salt forms thereof have been used to inhibit carbonyl based fouling, particularly aldehyde fouling, that often occurs during caustic scrubbing of liquid or gas phase hydrocarbon streams. However, the ethylenediamine compounds are expensive, and the method described herein using the carbohydrazide compounds provides a more economical treatment approach.

SUMMARY OF THE INVENTION

This invention relates to a method of inhibiting formation of fouling deposits during the basic washing of hydrocarbons contaminated with oxygen containing compounds. The method comprises adding to the wash an effective amount of carbohydrazide. The carbohydrazide treatment is well suited for inhibition of polymer based deposits formed during the caustic scrubbing of gas phase olefinic hydrocarbons resulting from the pyrolytic cracking process. This method prevents the carbonyl compounds, including ketone and aldehyde contaminants, from undergoing Aldol condensation and thereby forming insoluble polymer molecules. By eliminating the formation of insoluble polymers, system equipment is kept free of fouling deposits.

DETAILED DESCRIPTION OF THE PREFERRED EMBODIMENT

In accordance with the invention, carbohydrazide is added to the aqueous medium of a basic (i.e., pH >7) wash or scrubber system. The fouling inhibitor can be added to the caustic tower as neat material or in solution form. The preferred method of addition is as an aqueous solution with 0.1 to 10 weight percent carbohydrazide inhibitor present, with 6½ weight percent especially preferred, so that accurate metering of the inhibitor to the tower can be achieved.

Theoretically, one mole of carbohydrazide is needed for every two moles of aldehyde, i.e., 0.5:1. However, ratios as high as 10 moles of carbohydrazide per mole of aldehyde may be required, i.e., 10:1. Preferably, the feed rate ranges from one to three moles of carbohydrazide per mole of aldehyde, with a 1:1 mole ratio being especially preferred.

The treatment should be added to the wash in sufficient quantity to assure that the molar amount of carbohydrazide is sufficient to react with all of the undesirable carbonyl contaminants. Treatment ranges of from 1 to 10,000 ppm of carbohydrazide per one million parts of the aqueous scrubbing medium may be used if no convenient method of measuring carbonyl contents is available. Specifically, treatment ranges of from 100 to 200 ppm of carbohydrazide have been successfully used. In any event, an effective amount of carbohydrazide should be used to inhibit the formation of fouling deposits during the basic washing of hydrocarbons contaminated with carbonyl compounds.

The treatment is especially well adapted to inhibit polymer-based fouling in caustic wash systems wherein gaseous olefinic compounds are washed. These gas phase olefins comprise ethylene, propylene, butadiene, etc., which are formed from the pyrolytic cracking of hydrocarbon feedstock such as ethane, propane, butane, naphtha, or mixtures thereof. The invention may be utilized in any alkaline wash system but is particularly useful in caustic washes such as sodium hydroxide, potassium hydroxide, and in some of the organic caustic materials. The invention is further illustrated by the following example which is intended merely for the purpose of illustration and is not to be regarded as limiting the scope of the invention or the manner in which it may be practiced.

EXAMPLE 1

A 200 g aliquot of 5% aqueous sodium hydroxide (400 mL beaker) was dosed at an appropriate level with the desired antifoulant. The beaker was placed in a pressure vessel capable of accommodating magnetic stirring. A stirring bar was added along with 1 mL of vinyl acetate and the vessel was sealed. Nitrogen was introduced to reach a pressure of 75 psi; vigorous stirring was started and the vessel heated to 250° F. for six hours.

A 3 mL aliquot of 35% ethylenediamine in water was required to completely inhibit polymerization of a 1 mL aliquot of vinyl acetate. However, a 6 mL aliquot of 6½% carbohydrazide in water solution was required to inhibit polymerization of 1 mL of vinyl acetate.

While this invention has been described with respect to particular embodiments thereof, it is apparent that numerous other forms and modifications of this invention will be obvious to those skilled in the art. This invention generally should be construed to cover all such obvious forms and modifications that are within the true spirit and scope of the present invention. These variations are to be considered within the spirit and scope of the invention which is limited only by the following claims.

What is claimed is:

1. A method of inhibiting formation of polymeric fouling deposits during the caustic scrubbing of pyrolytically produced hydrocarbons contaminated with oxygen containing compounds with a basic washing solution having a pH >7 comprising adding to the basic washing solution a sufficient amount for inhibiting formation of polymeric fouling materials of carbohydrazide.

2. The method of claim 1 wherein said hydrocarbon being washed comprises an olefin.

3. The method of claim 2 wherein oxygen containing compounds are composed primarily of carbonyl compounds.

4. The method of claim 3 wherein said carbonyl compounds comprise aldehydes, ketones or mixtures thereof.

5. The method of claim 1 wherein the hydrocarbon being washed is produced by the pyrolytic cracking of hydrocarbon feedstocks.

6. The method of claim 5 wherein said hydrocarbon feedstocks are selected from the group consisting of ethane, propane, butane, naphtha and mixtures thereof.

7. The method of claim 1 wherein the hydrocarbon being washed is in a gaseous phase.

8. A method as recited in claim 3 wherein said carbohydrazide is added to said basic wash in the amount representing a molar ratio of said carbohydrazide to said carbonyl compounds from about 0.5:1 to about 10:1.

9. The method of claim 8 wherein said molar ratio is about 1:1.

10. The method of claim 8 wherein said molar ratio is from about 1:1 to about 3:1.

11. A method of inhibiting the formation and deposition of fouling materials on the structural parts of a wash system during basic washing with a solution having a pH >7 of a pyrolytically produced olefin compound or compounds contaminated with at least one carbonyl compounds, said method comprising adding to said basic wash a sufficient amount for inhibiting formation of polymeric fouling materials of carbohydrazide.

12. The method of claim 11 wherein said carbonyl compounds comprise aldehydes or ketones and mixtures thereof.

13. The method of claim 11 wherein said carbohydrazide is added to said basic wash in an amount representing a molar ratio of said carbohydrazide to said carbonyl compounds of from about 0.5:1 to about 10:1.

14. The method of claim 11 wherein said carbohydrazide is added a molar ratio of from about 1:1 to about 3:1.

15. The method of claim 11 wherein said carbohydrazide is added molar ratio of about 1:1.

16. The method of claim 11 wherein said olefin comprises a member selected from the group consisting of ethylene, propylene, butadiene and mixtures thereof.

17. The method of claim 16 wherein said olefin is in the gas phase.

* * * * *

UNITED STATES PATENT AND TRADEMARK OFFICE

CERTIFICATE OF CORRECTION

PATENT NO. : 5,160,425

DATED : November 3, 1992

INVENTOR(S) : Vincent E. Lewis

It is certified that error appears in the above-identified patent and that said Letters Patent is hereby corrected as shown below:

Column 4, Claim 11, line 6, please delete "compounds" and insert --compound-- in place thereof.

Column 4, Claim 14, line 2, please insert --in-- after "added."

Column 4, Claim 15, line 2, please insert --in a-- after "added."

Signed and Sealed this

Twelfth Day of October, 1993

Bruce Lehman

*Attest:*

BRUCE LEHMAN

*Attesting Officer*

*Commissioner of Patents and Trademarks*